US009145781B2

(12) United States Patent
Plante et al.

(10) Patent No.: US 9,145,781 B2
(45) Date of Patent: Sep. 29, 2015

(54) VANE SUPPORT ASSEMBLY

(75) Inventors: Kenneth M. Plante, Sanford, ME (US); John A. McCready, Dover, NH (US); John A. Szymbor, Sanford, ME (US)

(73) Assignee: United Technologies Corporation, Hartford, CT (US)

( * ) Notice: Subject to any disclaimer, the term of this patent is extended or adjusted under 35 U.S.C. 154(b) by 618 days.

(21) Appl. No.: 13/493,279

(22) Filed: Jun. 11, 2012

(65) Prior Publication Data

US 2013/0330176 A1 Dec. 12, 2013

(51) Int. Cl.
*F01D 9/04* (2006.01)

(52) U.S. Cl.
CPC ..... *F01D 9/041* (2013.01); *F05D 2230/10* (2013.01); *Y10T 29/53* (2015.01)

(58) Field of Classification Search
CPC ..... F01D 9/041; F01D 9/042; F01D 25/28; F01D 25/285; Y10T 29/53; F05D 2230/10
USPC ..... 415/1, 131, 149.2, 149.4, 155, 156, 415/157, 162, 209.1; 29/451, 889.2, 889.22
See application file for complete search history.

(56) References Cited

U.S. PATENT DOCUMENTS 3,053,504 A * 9/1962 Shelley ..... 416/215
4,128,929 A 12/1978 DeMusis
4,836,518 A * 6/1989 Janutta ..... 269/43
4,868,963 A * 9/1989 Corsmeier et al. ..... 29/888.025
4,874,031 A 10/1989 Janney
5,503,589 A 4/1996 Wikle
5,544,873 A 8/1996 Vickers et al.
5,645,466 A 7/1997 Wikle
5,794,338 A * 8/1998 Bowden et al. ..... 29/889.1
5,822,841 A 10/1998 Bales et al.
6,202,302 B1 3/2001 Descoteaux
6,855,033 B2 2/2005 Jones et al.
8,011,883 B2 9/2011 Schwarz et al.
2005/0191177 A1 9/2005 Anderson et al.
2010/0293786 A1 11/2010 Powers et al.
2012/0060370 A1 3/2012 Leibfried et al.

OTHER PUBLICATIONS

International Searching Authority, PCT Notification of Transmittal of the International Search Report and Written Opinion, Apr. 9, 2014, 9 pages.
European Patent Office, extended European search report, Jun. 9, 2015, 5 pages.

* cited by examiner

*Primary Examiner* — Dwayne J White
*Assistant Examiner* — Brian P Wolcott
(74) *Attorney, Agent, or Firm* — Kinney & Lange, P.A.

(57) ABSTRACT

An assembly includes a fixture, first and second vanes, and an insert. The first vane and the second vane are retained within the fixture and are spaced at a distance from one another. The insert is disposed between the first vane and the second vane and the insert includes a spring that exerts a force that is applied to both the first vane and the second vane.

16 Claims, 5 Drawing Sheets

VANE SUPPORT ASSEMBLY

BACKGROUND

The present invention relates to a gas turbine engine. In particular, the invention relates to an apparatus that aid in the manufacture or repair of gas turbine engine vanes.

A gas turbine engine ignites compressed air and fuel to create a flow of hot combustion gases to drive multiple stages of turbine blades. The turbine blades extract energy from the flow of hot combustion gases to drive a rotor. The turbine rotor drives a fan to provide thrust and drives a compressor to provide a flow of compressed air. In both the turbine and the compressor, stator vanes are interspersed between the multiple stages of blades to align the flow of gases for an efficient attack angle on the blades.

Stator vanes with a cantilevered-type configuration have been developed to reduce weight and improve manufacturability. For a variety of reasons, including efficiency, it is desirable to minimize clearance between the tip of the vane and adjacent rotor structures. Thus, tight tolerances between the tips of the vanes and the rotor are required. Such tolerances generally cannot be achieved when casting the vane, and therefore, the vanes are generally assembled and the tips of the vanes are machined to a desired tolerance.

One conventional technique for assembling the vanes for vane tip machining uses wax or plastic to encapsulate the stators. The wax or plastic acts to retain the vanes while a light grind is performed along the tip of each vane. After the grind is performed the wax or plastic is melted so that the vanes can be removed. The entire assembly and disassembly process is time consuming, and therefore, costly. Additionally, wax or plastic must be procured and disposed of with this processing method.

SUMMARY

An assembly includes a fixture, first and second vanes, and an insert. The first vane and the second vane are retained within the fixture and are spaced at a distance from one another. The insert is disposed between the first vane and the second vane and the insert includes a spring that exerts a force that is applied to both the first vane and the second vane.

In a further embodiment of any of the foregoing embodiments, the assembly may additionally or alternatively include that the insert comprises a circumferential array of a plurality of segments. In a further embodiment of any of the foregoing embodiments, the assembly may additionally or alternatively include that the insert has a liner on a first end and second end thereof, and wherein the liner makes contact with the first vane and the second vane. In a further embodiment of any of the foregoing embodiments, the assembly may additionally or alternatively include that the insert has a surface that extends between the first end and the second end, and wherein one or more slots extend into the surface.

In a further embodiment of any of the foregoing embodiments, the assembly may additionally or alternatively include a first band that abuts the liner on the first end, a second band that abuts the liner on the second end, the first band is spaced apart from the second band and held together by a fastener, and the spring is disposed between the first band and the second band. In a further embodiment of any of the foregoing embodiments, the assembly may additionally or alternatively include that the first vane and the second vane comprise adjacent stages for a gas turbine engine. In a further embodiment of any of the foregoing embodiments, the assembly may additionally or alternatively include that the first vane and the second vane each comprise a segmented circumferential array of a plurality of vanes. In a further embodiment of any of the foregoing embodiments, the assembly may additionally or alternatively include that the segmented circumferential array is comprised of singlets or doublets.

In a further embodiment of any of the foregoing embodiments, the assembly may additionally or alternatively include that the first and second vanes comprise a plurality of vanes, the plurality of vanes are spaced a distance from one another and comprise separate stages for a gas turbine engine, and the insert comprises a plurality of inserts disposed between each separate stage for the gas turbine engine, wherein each insert for each separate stage has a spring that applies a different amount of force to each separate stage. In a further embodiment of any of the foregoing embodiments, the assembly may additionally or alternatively include that the spring rates of each spring becomes progressively larger with each successive insert such that the plurality of vanes are progressively loaded with forces increasing in a same direction with respect to the fixture. In a further embodiment of any of the foregoing embodiments, the assembly may additionally or alternatively include that the same direction corresponds to a direction of loading experienced during operation of the gas turbine engine, and the same direction corresponds to a direction opposing a direction of air flow during operation of the gas turbine engine.

A kit includes a plurality of inserts and a removal tool. Each insert has a spring disposed therein and a liner on a first end and a second end thereof as well as one or more slots. The removal tool is adapted to insert into the one or more slots.

In a further embodiment of any of the foregoing embodiments, the kit may additionally or alternatively include that each insert comprises a circumferential array having of a plurality of segments. In a further embodiment of any of the foregoing embodiments, the kit may additionally or alternatively include that the one or more slots are disposed in a side surface of the inserts, and the side surface is covered by a thermoplastic. In a further embodiment of any of the foregoing embodiments, the kit may additionally or alternatively include a first band that abuts the liner on the first end and a second band that abuts the liner on the second end, the first band is spaced apart from the second band and held together by a fastener, and the spring is disposed between the first band and the second band. In a further embodiment of any of the foregoing embodiments, the kit may additionally or alternatively includes a spring rate for each spring of each insert is different such that a different amount of force is applied by each insert during operation.

A method of manufacture includes a fixture and a plurality of vanes arranged in the fixture. The plurality of vanes comprise adjacent stages for the gas turbine engine. The method applies a progressive load to the adjacent stages and grinds a tip of each of the plurality of vanes.

In a further embodiment of any of the foregoing embodiments, the method may additionally or alternatively include that the step of applying a progressive load includes an insert that is disposed between adjacent vanes to apply the progressive load between the adjacent vanes. In a further embodiment of any of the foregoing embodiments, the method may additionally or alternatively include that the fixture simulates a case for a gas turbine engine. In a further embodiment of any of the foregoing embodiments, the method may additionally or alternatively include that removing the insert with a removal tool.

DETAILED DESCRIPTION

Figure 1:
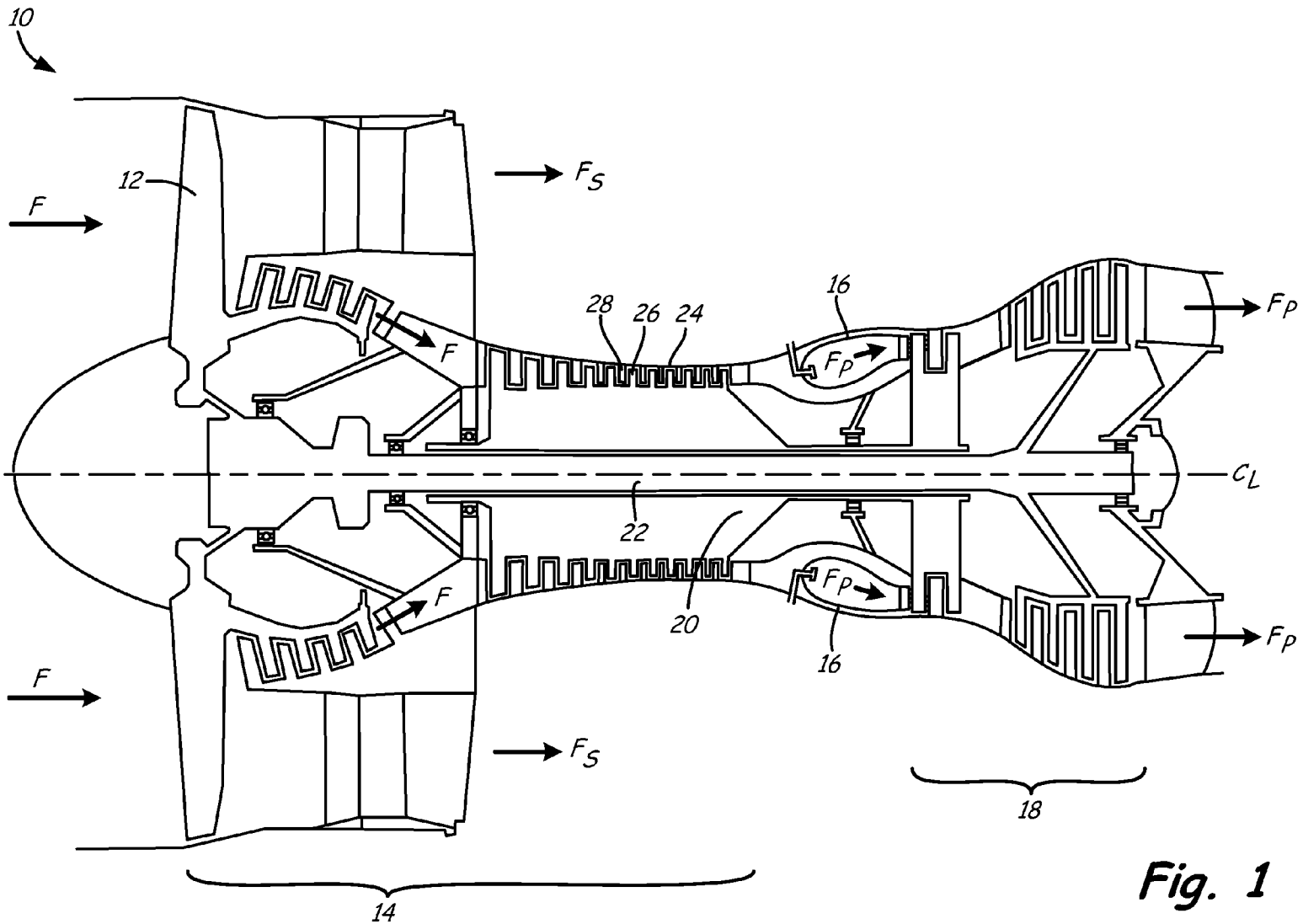
FIG. 1 is a representative illustration of a gas turbine engine.

FIG. 1 shows a representative gas turbine engine including engine stages with cantilevered stator vanes manufactured by the method described herein. The view in FIG. 1 is a longitudinal sectional view along an engine center line. FIG. 1 shows gas turbine engine 10 including a fan 12, a compressor 14, a combustor 16, a turbine 18, a high-pressure rotor 20, a low-pressure rotor 22, and an engine casing 24. Compressor 14 includes rotor blades 26 and cantilevered stator vanes 28.

As illustrated in FIG. 1, fan 12 is positioned along engine center line $C_L$ at one end of gas turbine engine 10. Compressor 14 is adjacent fan 12 along engine center line $C_L$, followed by combustor 16. Turbine 18 is located adjacent combustor 16, opposite compressor 14. High-pressure rotor 20 and low-pressure rotor 22 are mounted for rotation about engine center line $C_L$. High-pressure rotor 20 connects a high-pressure section of turbine 18 to compressor 14. Low-pressure rotor 22 connects a low-pressure section of turbine 18 to fan 12. Rotor stages 26 and stator stages 28 are arranged throughout turbine 18 in alternating rows. Rotor stages 26 connect to high-pressure rotor 20 and low-pressure rotor 22. Engine casing 24 surrounds turbine engine 10 providing structural support for compressor 14, combustor 16, and turbine 18, as well as containment for cooling air flows, as described below.

In operation, air flow F enters compressor 14 through fan 12. Cantilevered stator stages 28 in the compressor 14 decelerate and redirect the air flow F and act to properly align air flow F for an efficient attack angle on subsequent rotor stages 26. Air flow F is compressed by the rotation of compressor 14 driven by high-pressure rotor 20. The compressed air from compressor 14 is divided, with a portion going to combustor 16, and a portion employed for cooling components exposed to high-temperature combustion gases, such as stator vanes, as described below. Compressed air and fuel are mixed and ignited in combustor 16 to produce high-temperature, high-pressure combustion gases Fp. Combustion gases Fp exit combustor 16 into turbine section 18.

The flow of combustion gases Fp past rotor stages 26 drives rotation of both high-pressure rotor 20 and low-pressure rotor 22. High-pressure rotor 20 drives a high-pressure portion of compressor 14, as noted above, and low-pressure rotor 22 drives fan 12 to produce thrust Fs from gas turbine engine 10. Although embodiments of the present invention are illustrated for a turbofan gas turbine engine for aviation use, it is understood that the present invention applies to other aviation gas turbine engines and to industrial gas turbine engines as well.

Figure 2:
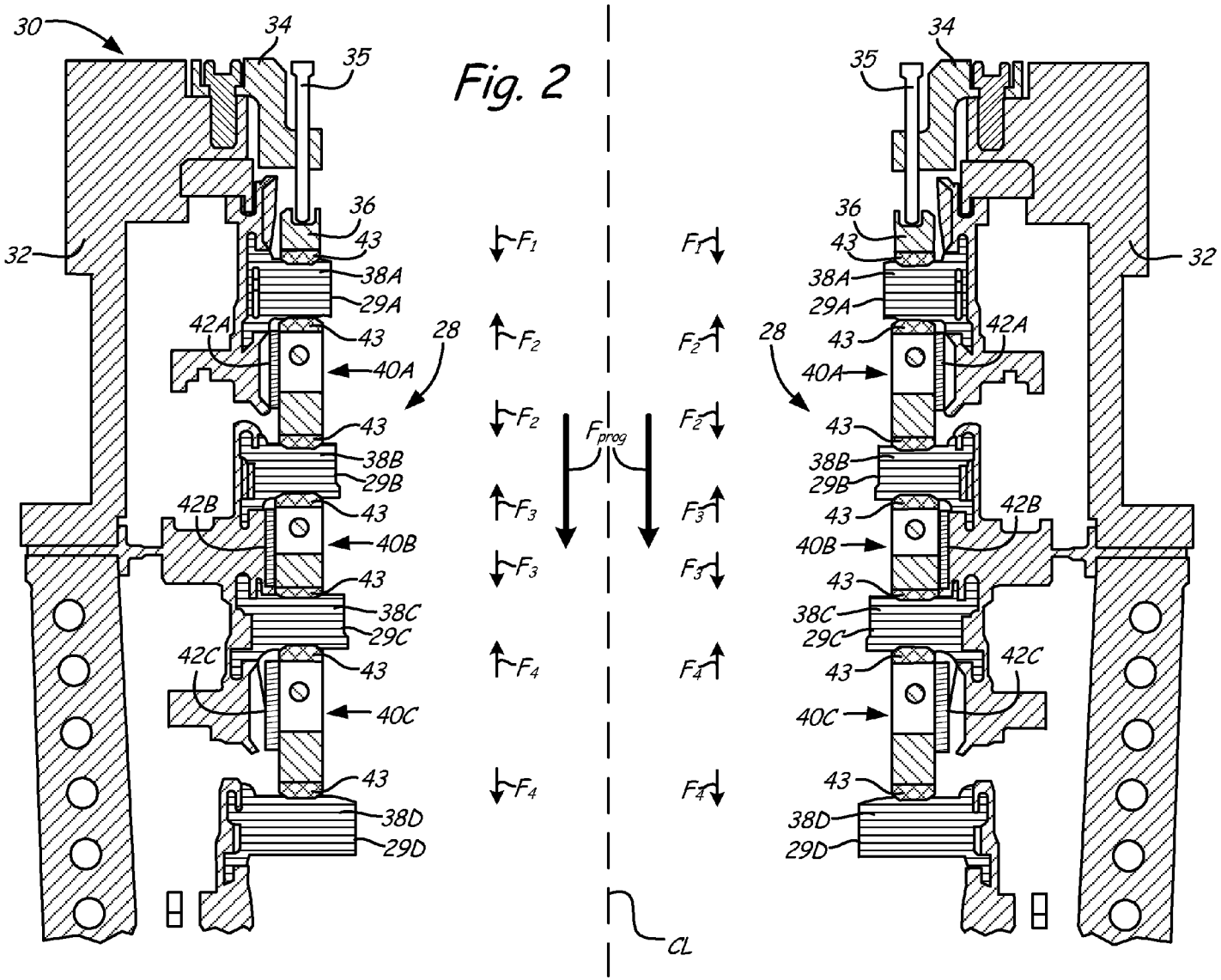
FIG. 2 is a partial cross-sectional view of one embodiment of an assembly according to the present invention.

FIG. 2 is a partial cross-sectional view of one embodiment of an assembly 30. Assembly 30 is used in the manufacture or repair of cantilevered stator vanes 28. Vanes 28 include vane tips 29A, 29B, 29C, and 29D. Assembly 30 includes a fixture 32, details 34, pins 35, a ring 36, vane stages 38A, 38B, 38C, and 38D, inserts 40A, 40B, and 40C, and standoffs 42A, 42B, and 42C. Ring 36 and inserts 40A, 40B, and 40C include liners 43. Ring 36 and inserts 40A, 40B, and 40C apply different forces $F_1$, $F_2$, $F_3$, and $F_4$ in the directions indicated. Forces $F_1$, $F_2$, $F_3$, and $F_4$ amount to a progressive force $F_{PROG}$ that decreases from vane stage to vane stage in a direction substantially parallel to a centerline axis $C_L$ of fixture 32.

Although shown in partial cross-section in FIG. 2, fixture 32 has a substantially circular shape and is oriented about centerline axis $C_L$. In one embodiment, fixture 32 is vertically oriented with respect to a surface that fixture 32 rests on. Fixture 32 is adapted to receive multiple stages 38A, 38B, 38C, and 38D of cantilevered stator vanes 28 therein. Although described in reference to manufacture or repair of high pressure compressor canilevered vanes, the inventive concepts described are equally applicable to other gas turbine engine components, for example, vanes in the turbine section.

Details 34 extend from a top portion of fixture 32. Each detail 34 is adapted to receive pin 35. Pin 35 extends generally parallel with centerline axis $C_L$ and contacts and seats against ring 36. In one embodiment, pin 35 comprises an Allen capscrew that turned down to apply force of vane stage 38A via ring 36. Ring 36 extends around the inner circumference of fixture 32 and makes contact with vane stage 38A. Although illustrated with two vanes 28 in FIG. 2, in some embodiments vane stage 38A comprises a circumferential array with a plurality of vanes. Similarly, vane stages 38B, 38C, and 38D can comprise circumferential arrays of vanes. In some embodiments, vane stages 38A, 38B, 38C, and 38D can be constructed of singlets or doublets.

Vane stage 38A is abutted by insert 40A in addition to ring 36. Insert 40A also abuts vane stage 38B. Insert 40B is disposed between and abuts vane stage 38B and vane stage 38C. Insert 40C is disposed between and abuts vane stage 38C and vane stage 38D. Standoffs 42A, 42B, and 42C extend from a surface on each insert 40A, 40B, and 40C. Liners 43 cover the contact surfaces of inserts 40A, 40B, and 40C and ring 36.

In one embodiment, liners 43 comprise a dense rubber such as a SC 610 neoprene synthetic rubber. Liners 43 are applied to reduce instances of shattering, cracking, or otherwise damaging vanes 28 during manufacture. Standoffs 42A, 42B, and 42C abut fixture 32 and have differing sizes to substantially align each insert 40A, 40B, and 40C with respect to one another for application of forces $F_1$, $F_2$, $F_3$, and $F_4$ in a similar direction.

Stator vanes 28 are retained at platforms and extend generally toward centerline axis $C_L$ to allow tips 29A, 29B, 29C, and 29D to be easily accessed and machined in the open center of assembly 30. Assembly 30 allows tips 29A, 29B, 29C, and 29D of each vane stage 38A, 38B, 38C, and 38D to be machined to be substantially co-planar about centerline axis $C_L$. Machining typically includes a non-aggressive grind (removal of a few thousandths of an inch of material) of tips 29A, 29B, 29C, and 29D with a cylindrical grinder, but additional manufacturing processes can be performed as necessary.

Fixture 32 can be sized to simulate case 24 (FIG. 1) of gas turbine engine 10 (FIG. 1). Were the fixture 32 and gas turbine engine 10 superimposed, centerline axis $C_L$ of fixture 32 would substantially align with centerline axis $C_L$. Sizing fixture 32 to simulate case 24 (FIG. 1) allows for ease of measurement to ascertain if tips 29A, 29B, 29C, and 29D are within a desired tolerance relative to rotor structures when installed in gas turbine engine 10.

Progressive force $F_{PROG}$ (used for illustration purposes to indicate the overall direction in which forces $F_1$, $F_2$, $F_3$, and $F_4$ decrease) is applied in the following manner. Removable details 34 can be installed to extend inward from fixture 32 at a top end thereof. Each detail 34 receives pin 35 which is torqued down relative to detail 34 to apply a force on ring 36. This arrangement transfers force $F_1$ to vane stage 38A. In the embodiment described, force $F_1$ comprises the largest force of forces $F_1$, $F_2$, $F_3$, and $F_4$, and each force becomes smaller with travel along assembly 30 away from force $F_1$. Thus, force $F_1$ is larger than force $F_2$, and force $F_2$ is greater than force $F_3$, etc.

Insert 40A is disposed on an opposing side of vane stage 38A from ring 36. As will be discussed in further detail subsequently, insert 40A has springs therein which cause insert 40A to expand and exert force $F_2$ on vane stage 38A. Because $F_2$ comprises a smaller force than $F_1$, vane stage 38A shifts relative to fixture 32 to position vane stage 38A and tips 29A in a location which simulates their position during operation of the gas turbine engine 10 (FIG. 1). In other words, the differential force between $F_1$ and $F_2$ simulates a high/low pressure differential that vanes 28 experience during engine run conditions due to their shape and disposition. The direction of the differential force between $F_1$ and $F_2$, and the direction of progressive force $F_{PROG}$ in general is in a direction generally opposing the direction of air flow through the gas turbine engine 10 (FIG. 1).

Similarly, progressively decreasing forces $F_2$, $F_3$, and $F_4$ are applied by inserts 40A, 40B, and 40C to vane stages 38B, 38C, and 38D, respectively. The difference between the applied forces $F_2$, $F_3$, and $F_4$ shifts vane stages 38B, 38C, and 38D relative to fixture 32 to position vane stages 38B, 38C, and 38D and tips 29B, 29C, and 29D in a location which simulates their position during operation of gas turbine engine 10 (FIG. 1). Forces $F_1$, $F_2$, $F_3$, and $F_4$ become progressively smaller so that if one insert 40A, 40B, and 40C or ring 36 is removed due to failure or to facilitate removal of vane stage 38A, 38B, 38C, or 38D the remaining vane stages 38A, 38B, 38C, and 38D are retained in the location which simulates their position during engine run conditions so as not to interfere with the machining process.

Because the progressive force $F_{PROG}$ arrangement simulates engine run positioning of tips 29A, 29B, 29C, and 29D, the progressive force $F_{PROG}$ arrangement allows tips 29A, 29B, 29C, and 29D to achieve more accurate tolerances in relation to engine 10 (FIG. 1) components such as rotor structures. Due to more accurate tolerances of tips 29A, 29B, 29C, and 29D, greater engine performance and reduced instances of rotor/stator binding are achieved.

Figure 3:
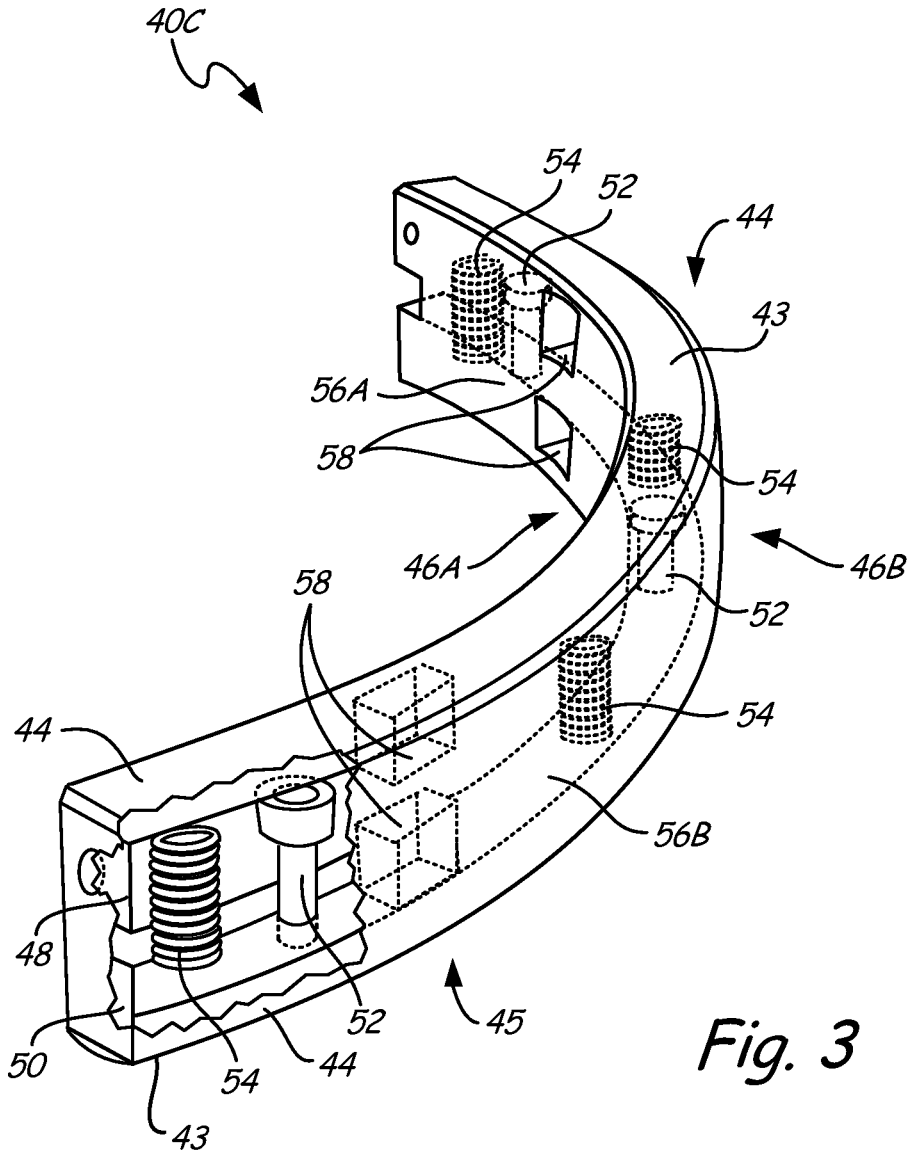
FIG. 3 is an elevated perspective view of one embodiment of an insert with portions of the insert broken away to reveal internal components.

FIG. 3 is an elevated perspective view of one segment of insert 40C with portions broken away to reveal internal components. Insert 40C includes a first end 44, a second end 45, sides 46A and 46B, a first band 48, a second band 50, fasteners 52, and springs 54. First end 44 and second end 45 are covered by liners 43. Side 46A is covered by skirting 56A and includes slots 58 therein. Side 46B is covered by skirting 56B.

In the embodiment shown, insert 40C extends in an arc comprising substantially 90°. First end 44 is adapted to interface with vanes 28 (FIG. 2). Second end 45 is disposed opposite from first end 44 and is adapted to interface with vanes 28. Both first end 44 and second end 45 are covered by liners 43.

Sides 46A and 46B connect first end 44 with second end 45. First end 44 and portions of sides 46A and 46B are formed internally by first band 48. Second band 50 forms second end 45 and portions of sides 46A and 46B. First band 48 and second band 50 are constructed of a sturdy light-weight material such as aluminum. Second band 50 is retained to first band 48 by fasteners 52 such as shoulder screws. Additionally, second band 50 is spaced apart from first band 48 by springs 54 that are disposed therebetween. Insert 40C can be assembled to comprise a full circumference by abutting liner 40C with additional liners. Liners can be connected by screws, fasteners, or other known means.

Side 46A is covered by skirting 56A and side 46B is covered by skirting 56B. In one embodiment, skirting 56A and 56B comprises a thin thermoplastic material, which is utilized to minimize contamination from grinding fluids. Side 46A additionally includes slots 58 therein. Slots 58 are formed in skirting 56A as well as first and second bands 48 and 50.

Liner 43 is applied along first end 44 and second end 45 to reduce instances of shattering, cracking, or otherwise damaging vanes 28 (FIG. 2) during manufacture. Fasteners 52 are received in first band 48 and second band 50 and limit the distance bands 48 and 50 can separate from one another. Force that tends to try to cause separation of first band 48 from second band 50 is applied by springs 54, which are received in first band 48 and second band 50. Springs 54 have a generally similar spring rate. However, springs for different inserts (e.g., 40A and 40B of FIG. 2) have different spring rates from one another to allow assembly 30 (FIG. 2) to have the progressive force $F_{PROG}$ arrangement previously described.

Figure 4:
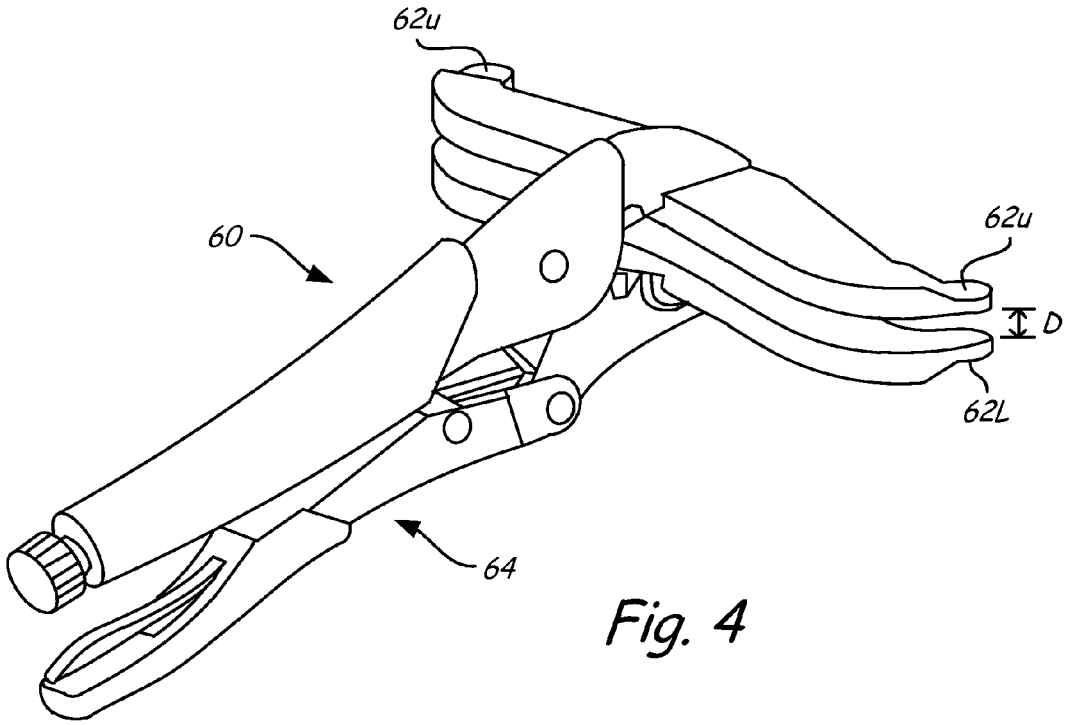
FIG. 4 is a perspective view of one embodiment of a removal tool for the insert.

FIG. 4 shows a perspective view of one embodiment of a removal tool 60. In the embodiment shown, removal tool 60 has upper tongs 62U and lower tongs 62L separated by an adjustable distance D and a handle 64.

Removal tool 60 comprises a modified vise-grip type device. Upper tongs 62U and lower tongs 62L extend from a distal end of removal tool 60 forward of handle 64. Tongs 62U and 62L are sized to insert in slots 58 of insert 40C (FIG. 3).

To remove insert 40C, tongs 62U and 62L are placed in slots 58 and handle 64 is actuated to close adjustable distance D between upper tongs 62U and lower tongs 62L. Tongs 62U and 62L are actuated until they exert a clamping force on inert 40C between slots 58.

Figure 5:
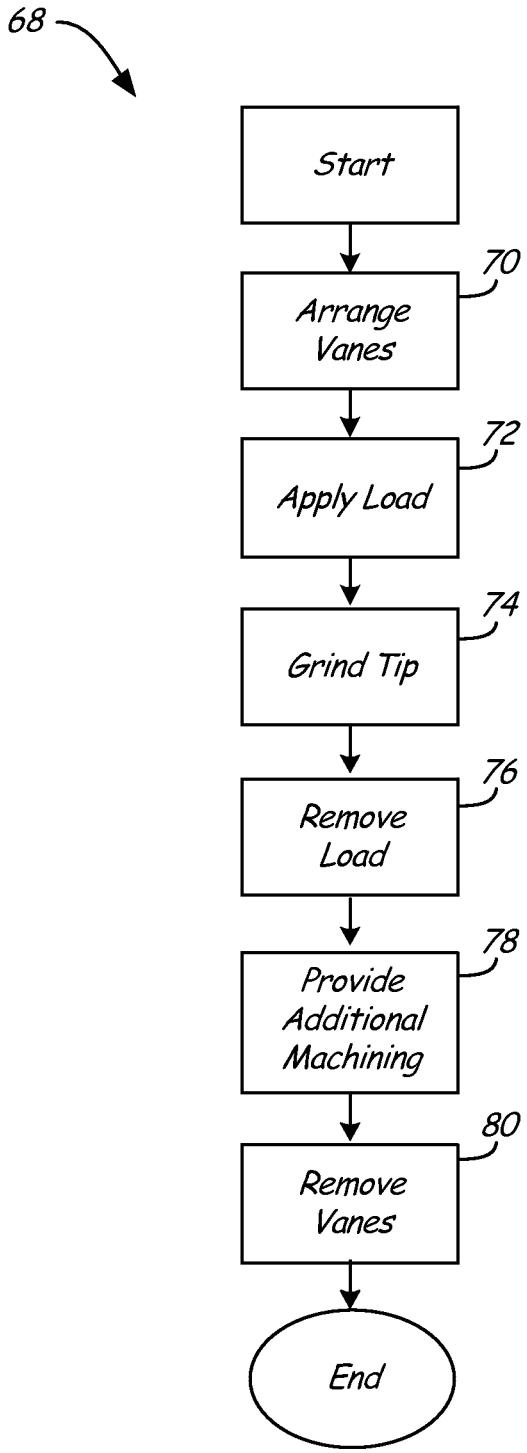
FIG. 5 is a flow chart illustrating a method of manufacture to achieve a desired tip tolerance for cantilevered stator vanes.

FIG. 5 is a flow chart illustrating a method of manufacture to achieve a desired tip tolerance for cantilevered stator vanes. Method 68 has a step 70 where a plurality of vanes are arranged within a fixture. These vanes comprise adjacent stages for the gas turbine engine. In step 72, a progressive load is applied to the separate adjacent stages. The progressive load can be applied by an inserts that are disposed between adjacent vanes. A tip of each of the plurality of vanes is ground with a grinding tool at step 74. The progressive load is removed (step 76) and additional machining of vanes can be performed (step 78). Vanes are then removed from the fixture at step 80.

The present invention describes a fixture and inserts assembly that applies a progressive force which tilts vanes for more accurate tolerance in relation to engine components when machining. Due to more accurate tolerances of tips greater engine performance and reduced instances of rotor/stator binding are achieved.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An assembly comprising:

a fixture;

a first plurality of vanes and a second plurality of vanes retained within the fixture, wherein the first and second pluralities of vanes are spaced a distance from one another and comprise separate stages for a gas turbine engine; and a plurality of inserts disposed between each separate stage for the gas turbine engine, wherein each insert for each separate stage includes a spring that exerts a force that is applied in different amounts to each separate stage, and wherein the spring rates of each spring becomes progressively larger with each successive insert such that the plurality of vanes are progressively loaded with forces increasing in a same direction with respect to the fixture.

2. The assembly of claim 1, wherein the plurality of inserts comprise a circumferential array.

3. The assembly of claim 1, wherein each insert has a liner on a first end and second end thereof, and wherein each liner makes contact with the first plurality of vanes and the second plurality of vanes.

4. The assembly of claim 3, wherein each insert has a surface that extends between the first end and the second end, and wherein one or more slots extend into the surface.

5. The assembly of claim 4, wherein each insert includes:

a first band that abuts the liner on the first end; and a second band that abuts the liner on the second end, wherein the first band is spaced apart from the second band and held together by a fastener, and wherein the spring is disposed between the first band and the second band.

6. The assembly of claim 1, wherein the first plurality of vanes and the second plurality of vanes comprise adjacent stages for a gas turbine engine.

7. The assembly of claim 6, wherein the first plurality of vanes and the second plurality of vanes each comprise a segmented circumferential array.

8. The assembly of claim 7, wherein the segmented circumferential array is comprised of singlets or doublets.

9. The assembly of claim 1, wherein the same direction corresponds to a direction of loading experienced during operation of the gas turbine engine, and wherein the same direction corresponds to a direction opposing a direction of air flow during operation of the gas turbine engine.

10. A kit comprising:

a plurality of inserts, wherein each insert has a spring disposed therein and a liner on a first end and a second end thereof, and wherein a spring rate for each spring of each insert is different such that a different amount of force is applied by each insert during operation, and wherein each insert has one or more slots; and a removal tool adapted to insert into the one or more slots.

11. The kit of claim 10, wherein each insert comprises a circumferential array having a plurality of segments.

12. The kit of claim 10, wherein the one or more slots are disposed in a side surface of the inserts, and wherein the side surface is covered by a thermoplastic.

13. The kit of claim 10, wherein the insert includes:

a first band that abuts the liner on the first end; and a second band that abuts the liner on the second end, wherein the first band is spaced apart from the second band and held together by a fastener, and wherein the spring is disposed between the first band and the second band.

14. A method of manufacture for a gas turbine engine, comprising:

arranging a plurality of vanes within a fixture, wherein the plurality of vanes comprise adjacent stages for the gas turbine engine;

applying a progressive load to the adjacent stages; and grinding a tip of each of the plurality of vanes, wherein the step of applying a progressive load includes an insert that is disposed between and abutting axially adjacent vanes to apply the progressive load between the axially adjacent vanes.

15. The method of claim 14, wherein the fixture simulates a case for a gas turbine engine.

16. The method of claim 14, further comprising removing the insert with a removal tool.

* * * * *